US009067248B2

(12) United States Patent
Kenjale et al.

(10) Patent No.: US 9,067,248 B2
(45) Date of Patent: Jun. 30, 2015

(54) NO-SLIT HOT ROLLING OF RAILROAD RAILS

(75) Inventors: Bhupendra Kenjale, El Paso, TX (US); Alfredo Cardona, El Paso, TX (US); Kishan Raghunath, El Paso, TX (US); Luis Garcia, El Paso, TX (US); Mark Fenenbock, El Paso, TX (US)

(73) Assignee: W. SILVER INC., Vinton, TX (US)

( * ) Notice: Subject to any disclaimer, the term of this patent is extended or adjusted under 35 U.S.C. 154(b) by 878 days.

(21) Appl. No.: 13/247,389

(22) Filed: Sep. 28, 2011

(65) Prior Publication Data

US 2013/0074566 A1 Mar. 28, 2013

(51) Int. Cl.
*B21B 1/085* (2006.01)

(52) U.S. Cl.
CPC ..... *B21B 1/0855* (2013.01)

(58) Field of Classification Search
CPC ..... B21B 1/08; B21B 1/085; B21B 1/0805; B21B 1/0855
USPC ..... 72/200, 234, 366.2, 199, 226, 365.2, 72/362, 220, 221, 23; 29/403.2, 403.1, 29/592, 412, 414, 557; 225/1
See application file for complete search history.

(56) References Cited

U.S. PATENT DOCUMENTS 185,316 A 12/1876 Garrett
219,616 A 9/1879 Brunner
219,722 A 9/1879 Hayden et al.
220,240 A 10/1879 Hewitt
226,982 A 4/1880 Davis
227,010 A 4/1880 Holub et al.
242,534 A 6/1881 Holub et al.
249,742 A 11/1881 Buchingham
294,757 A 3/1884 Brown
305,808 A 9/1884 Greer
305,809 A 9/1884 Greer
328,937 A 10/1885 Hargreaves
335,879 A 2/1886 Beach
371,359 A 10/1887 Reese
451,002 A 4/1891 Harris
532,424 A 1/1895 Maus
664,001 A 12/1900 Nisbett et al.
722,152 A 3/1903 Sellers
807,650 A 12/1905 York
852,983 A 5/1907 Slick
885,508 A 4/1908 McKee
1,086,789 A 2/1914 Slick
1,206,606 A 11/1916 Slick
1,883,338 A 10/1932 Connors
1,910,271 A 5/1933 Williams
2,040,494 A 5/1936 Miller (Continued)

*Primary Examiner* — Peter DungBa Vo
*Assistant Examiner* — Joshua D Anderson
(74) *Attorney, Agent, or Firm* — Greer Burns & Crain, Ltd.

(57) ABSTRACT

A method of recycling a one-piece rail having a base portion and a head portion spaced from each other by a substantially flat web portion. The steps include: heating the rail to a plastic state; feeding the heated rail through a first reduction pass to reduce a cross section of the rail without slitting the rail, thereby forming a bar; feeding the bar through a second reduction pass in which the cross section of the bar is further modified and then slitting the bar along the web portion into two bar pieces, one containing the former head portion and one containing the former base portion, as the bar leaves the second reduction pass; and rolling the two bar pieces, in a single pass line, through a series of reduction passes to produce a desired final cross section of the pieces.

15 Claims, 3 Drawing Sheets

(56) References Cited

U.S. PATENT DOCUMENTS

| | | | |
|---|---|---|---|
| 4,268,948 | A | 5/1981 | Strandell et al. |
| 4,357,819 | A | 11/1982 | Elly |
| 4,779,439 | A | 10/1988 | Baldi |
| 4,982,591 | A | 1/1991 | McGahhey |
| 5,526,667 | A | 6/1996 | Baldi et al. |
| 5,548,986 | A | 8/1996 | Matsuo et al. |
| 7,073,238 | B1 | 7/2006 | Moore et al. |
| 7,996,973 | B2 | 8/2011 | Moore et al. |

NO-SLIT HOT ROLLING OF RAILROAD RAILS

BACKGROUND OF THE INVENTION

The present invention relates to a process of recycling worn railroad rails.

There are known processes for recycling worn railroad rails which involve heating the rail within a furnace to a plastic state for molding thereof by means of rolling operations. Often, such rolling operations are associated with separate processing of cut portions of the rail, such as its head, web and base. In some instances, all portions of the worn rail are processed along one shaping line into bar products, such as fence posts or rebars.

The recycling of worn rails without cutting thereof has been proposed, as disclosed for example in U.S. Pat. Nos. 328,937, 852,983, 1,086,789 and 1,206,606. Such prior known methods of recycling worn rails have never proved successful in producing a one-piece billet or slab, because of problems created by the formation of laps, seams and folds during the rolling operations, giving rise to quality defects in the product produced. It is also known from U.S. Pat. No. 4,982,591 to heat a worn, one-piece rail to a plastic state which is initially deformed by a multi-stage rolling action to a slab constituted by flattened base and head extensions of an undeformed web portion of the rail. The slab is then edged in stages to effect thicknening of its intermediate portion and formation of a billet without any lapping, seaming or folding.

Further, it is known from U.S. Pat. Nos. 7,073,238 and 7,996,973 to heat the rail and slit it into two pieces in a first reduction pass and then subsequently pass the two pieces through a single mill pass line such that each piece of the rail is deformed to have a generally uniform shape. In the event that the rail has a through hole in a web portion of the rail, the slit preferably occurs through the area of the hole.

A problem encountered with the processing of rails, particularly where the rails are slit into separate pieces, is that the size and configuration of the head portion of the rails may vary greatly from rail to rail due to different wearing history of the bearing surface of the rail. Depending on when the rail was replaced, traffic conditions during rail usage, weather and orientation of the rail, the size and shape of the head portion may vary greatly from its initial size and shape. When the rail is slit into pieces before it is reshaped to any degree, the variations in the head size will be maintained as variations in the size of the pieces, making it difficult to process the rail pieces in a single line pass operation and to achieve substantially identical final end piece sizes.

A solution to this problem would be an improvement in the art.

SUMMARY OF THE INVENTION

In an embodiment, the present invention provides a method of recycling a one-piece rail having a base portion and a head portion spaced from each other along an axis by a substantially flat web portion. The method includes a step of heating the material of the rail to a plastic state. Another step includes feeding the heated rail through a first reduction pass to form a bar having a former head portion, a web portion and an former base portion in which a starting cross section of the rail is reduced in at least one dimension without slitting the rail. For this reason, the method of the present invention is referred to as "no-slit" since it leaves the first reduction pass without being slit. Another step includes feeding the bar through a second reduction pass in which the cross section of the bar is further modified.

The method proceeds with the step of slitting the bar along the web portion into two bar pieces, one piece containing the head portion and one piece containing the base portion, as the bar leaves the second reduction pass. Another step includes rolling the two pieces of the bar, in a single pass line, through a series of reduction passes to produce a desired final cross section of the bar pieces.

In an embodiment, the rail is heated to a temperature of at least 1900° F. prior to being fed into the first reduction pass.

In an embodiment, the rail initially has a width in a direction from the base portion to the head portion, a height of the head portion perpendicular to the width and a height of the base portion perpendicular to the width being greater than a height of the web portion, and in the first reduction pass the rail is deformed into the bar so as to make the head portion smaller and the base portion smaller than their initial heights.

In an embodiment, in the first reduction pass, as the rail is deformed into the bar, the width of the rail increases.

In an embodiment, in the first reduction pass, as the rail is deformed into the bar, the height of the web portion remains substantially unchanged.

In an embodiment, in the second reduction pass, the bar is maintained at a temperature sufficient to cause the material of the bar to remain in a plastic state.

In an embodiment, in the second reduction pass the bar is further deformed so as to make the former head portion smaller and the former base portion smaller than their heights following the first reduction pass.

In an embodiment, in the second reduction pass, the heights of the former head portion, the former base portion and the web portion are made substantially identical.

In an embodiment, at the exit of the second reduction pass, the bar is slit into two substantially identical bar pieces.

In an embodiment, in the second reduction pass, the bar is maintained at a temperature sufficient to cause the material of the bar to remain in a plastic state.

In an embodiment, at the third reduction pass, the two bar pieces pass through identical shaped rollers to produce substantially identical shaped pieces.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DETAILED DESCRIPTION OF THE PREFERRED EMBODIMENTS

Figure 1:
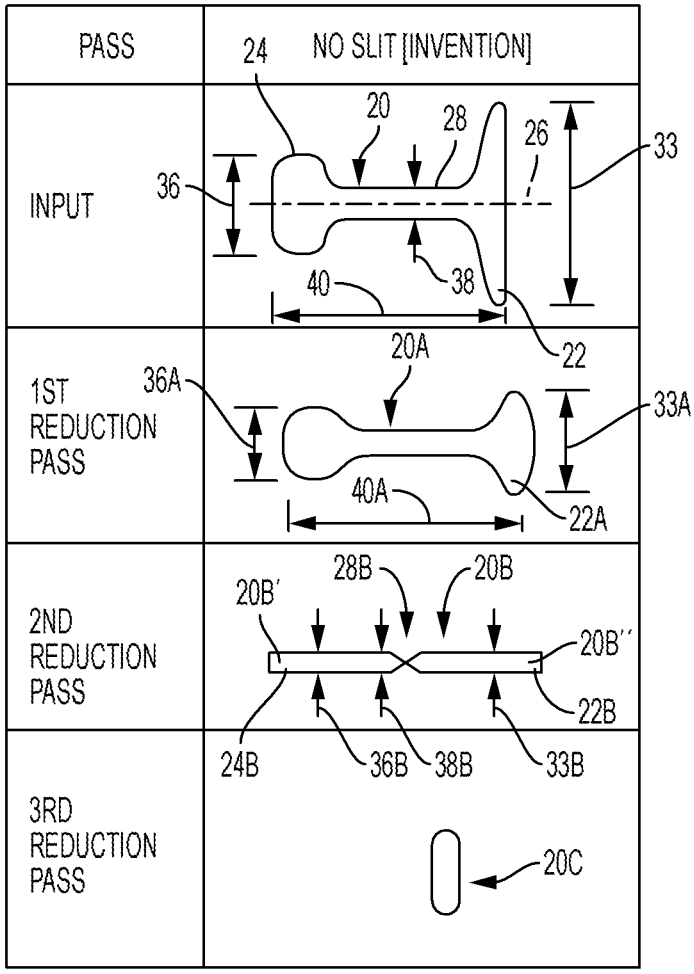
FIG. 1 is a chart showing the cross section of a typical rail at various steps of the present method.
Figure 2:
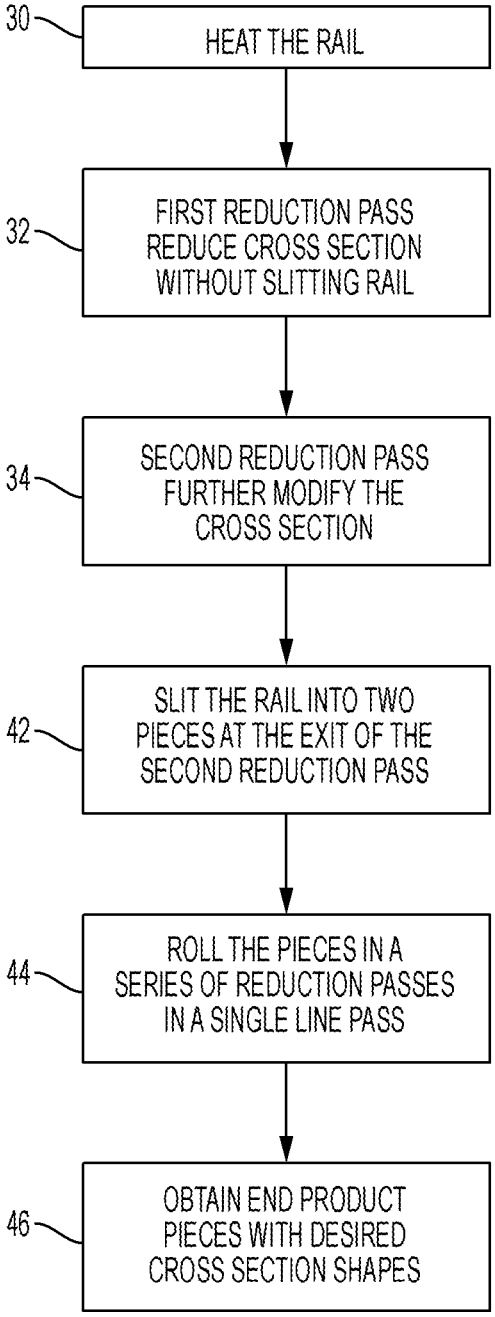
FIG. 2 is a schematic flow chart of steps of a method embodying the present invention.

FIG. 2 illustrates a method of recycling a one-piece elongated rail 20 (see FIGS. 1 and 3) having a base portion 22 and a head portion 24 spaced from each other along an axis 26 by a substantially flat web portion 28, embodying the principles of the present invention in a schematic flow chart form. In step 30 (FIG. 2), the rail 20 is heated to a plastic state. In the case of a typical railroad rail, heating to a temperature of at least 1900° F. is sufficient to place the rail in a plastic state. This is typically accomplished by placing the rail 20 in a furnace and allowing the rail to remain in the furnace for a given period of time, such as 20 to 30 minutes. In this plastic state, the rail 20 may be deformed by passing it through a series of opposed rollers that have surface configurations shaped in a desired surface outline for the rail to become after passing between the rollers. Each set of opposed rollers is referred to as a reduction pass. Such a process is known and is described in some detail in earlier patents such as U.S. Pat. Nos. 4,982,591, 7,073,238 and 7,996,973, the disclosures of which are incorporated herein by reference.

In step 32, the heated rail 20 is fed through a first reduction pass (a first pair of opposed rollers used to change the cross sectional shape of the rail) in a direction of an elongated length of the rail in which a cross sectional shape of the former rail is modified without slitting the rail and which results in a bar 20A (FIG. 1) shaped differently than the rail 20. In a particular embodiment of the process, the rail 20 may be introduced to the first reduction pass in an orientation wherein the rail is rotated about its longitudinal axis by 90° from its normal orientation when in use, so that the head portion 24 and the base portion 22 are arranged generally horizontal relative to one another (in the orientation shown in FIGS. 1 and 3). Guiding mechanisms are provided to hold the rail 20 in this orientation for presentation to the rollers of the first reduction pass. In other embodiments, the rail 20 may be introduced to the first reduction pass in an upright (normal use orientation) position, however the process will be described herein with the rail in the rotated orientation.

Figure 3:
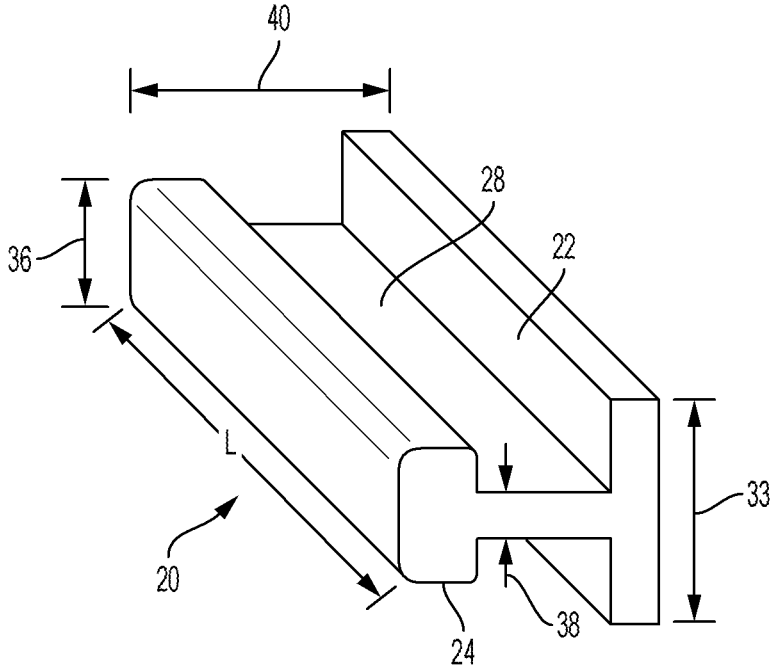
FIG. 3 is a perspective view of a rail that can be used in the initial steps of the method.

Typically initially the base portion 22 has a dimension 33, referred to in this rotated orientation as a height, greater than a corresponding dimension 36, also referred to as a height, of the head portion 24. Both of these heights 33, 36 are initially greater than a height 38 of the web portion 28. Throughout this document the term "height" is meant to mean the dimension that is parallel to a smallest dimension of the web portion 28 of the rail, regardless of the orientation of the rail 20 as it is presented to the first reduction pass. The height dimension extends perpendicular to an elongated length L of the rail 20 (FIG. 3). A width dimension of the rail is meant to be perpendicular to both the height and length and extends in a direction of the spacing of the head portion 24 from the base portion 22 by the web portion 28.

The actual size and shape of the head portion 24 may vary from rail to rail due to differences in the wearing of the bearing surface of the rail and the point at which the rail was removed for recycling. In is in particular this variation of head portion size from rail to rail that renders the present invention more favorable than earlier processes in that the rail is first modified in shape and cross section in the first reduction pass and the second reduction pass before being split so that variations between the two split pieces are minimized. Following the first reduction pass, the cross sectional shape of the former rail is changed sufficiently such that it no longer is considered to be a rail, but instead is now referred to as a bar 20A.

In an embodiment, in the first reduction pass of step 32, the rail 20 is deformed into the bar 20A so as to make a height 36A of a former head portion 24A smaller and a height 33A of a former base portion 22A smaller than their initial heights. In some embodiments, as the heights 33, 36 are decreased in the first reduction pass, the width 40A of the bar 20A from the base portion 22 to the head portion 24 is increased. This increase is referred to as the spread of the material of the rail. Also, in some embodiments, in the first reduction pass of step 32, as the rail 20 is deformed, the height 38 of the web portion 28 remains substantially unchanged.

Another step 34 includes feeding the bar 20A through a second reduction pass in which the cross section of the bar is further modified as shown by bar 20B in FIG. 1. In an embodiment, in the second reduction pass, the bar 20A/20B is maintained at a temperature sufficient to cause the material of the bar to remain in a plastic state. In this second reduction pass, the height 36B of the former head portion 24B, the height 33B of the former base portion 22B and the height 38B of the former web portion 28B may be changed to be approximately equal to each other. In such a step, the heights 33A, 36A of the former base portion 22A and the former head portion 24A may be further decreased.

The method proceeds to step 42 with the slitting of the bar 20B along the web portion 28B into two pieces (20B' and 20B" in FIG. 1), one piece 20B' containing the former head portion 24B and one piece 20B" containing the former base portion 22B, as the bar leaves the second reduction pass. In an embodiment, at the exit of the second reduction pass, the bar 20B is slit into two substantially identical bar pieces.

The method proceeds to step 44 which includes rolling the two pieces 20B' and 20B" of the bar 20B, in a single pass line, through a series of reduction passes to produce (step 46) a desired final cross section 20C of the pieces 20B' and 20B" shown in FIG. 1). The orientation of the bar pieces 20B', 20B" may change from reduction pass to reduction pass, such as by rotating the pieces by 90° around the longitudinal axis between various reduction passes. In an embodiment, at a third and subsequent reduction passes, the two bar pieces 20B', 20B" pass through identical shaped rollers, such as the same rollers, to produce substantially identical shaped pieces. When the bar pieces 20B', 20B" actually pass through the same rollers, they do so one at a time, one after the other. To the extent that there are any edge or near edge imperfections on the bar pieces 20B', 20B", such as openings or partial openings, they can be removed, for example with a shearing operation between appropriate reduction passes.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A method of recycling a one-piece rail having a base portion and a head portion spaced from each other along an axis by a substantially flat web portion, said method comprising:

heating the material of the rail to a plastic state, feeding the heated rail through a first reduction pass to form a bar having a former head portion, a web portion and a former base portion in which a starting cross section of the rail is reduced in at least one dimension without slitting the rail or the bar, feeding the bar through a second reduction pass in which the cross section of the bar is further modified such that the height of the former head portion, the height of the former base portion, and the web portion are substantially equal to each other, slitting the bar along the web portion into two substantially identical pieces, one piece containing the head portion and one piece containing the base portion, as the bar leaves the second reduction pass, rolling the two pieces of the bar through a series of reduction passes to produce a desired final cross section of the bar pieces, whereby both bars are passed through identical shaped rollers to produce substantially identical shaped bar pieces.

2. The method according to claim 1, wherein the rail is heated to a temperature to cause the material of the rail to be in a plastic state prior to being fed into the first reduction pass.

3. The method according to claim 1, wherein the rail initially has a width in a direction from the base portion to the head portion, a height of the head portion perpendicular to the width and a height of the base portion perpendicular to the width being greater than a height of the web portion, and in the first reduction pass the rail is deformed so as to make the height of the head portion smaller and the height of the base portion smaller than their initial heights.

4. The method according to claim 3, wherein in the first reduction pass, as the rail is deformed into the bar, the width of the rail increases.

5. The method according to claim 3, wherein in the first reduction pass, as the rail is deformed into the bar, the height of the web portion remains substantially unchanged.

6. The method according to claim 3, wherein in the second reduction pass the bar is further deformed so as to make the former head portion smaller and the former base portion smaller than their heights following the first reduction pass.

7. The method according to claim 3, wherein in the second reduction pass, the heights of the former head portion, the former base portion and the web portion are made substantially identical.

8. The method according to claim 1, wherein in the second reduction pass, the bar is maintained at a temperature sufficient to cause the material of the bar to remain in a plastic state.

9. The method according to claim 1, wherein in the second reduction pass, the bar is maintained at a temperature sufficient to cause the material of the bar to remain in a plastic state.

10. The method according to claim 1, wherein during said step of rolling the two pieces of the bar through said series of reduction passes, the two pieces of the bar both pass through the same reduction passes, with one of the two pieces of the bar passing through each pass before the other of the two pieces of the bar.

11. A method of recycling a one-piece elongated rail having a base portion and a head portion spaced from each other by a web portion, the rail having a length in a direction of elongation of the rail, a width perpendicular to the length in a direction of the spacing of the head portion from the base portion by the web portion, and a height of each of the head portion, the base portion and the web portion in a direction perpendicular to both the length and the width, the method comprising the following steps:

heating the rail to a plastic state, feeding the heated rail in a direction of the length through a first reduction pass to form a bar having a former head portion, a web and a former base portion in which the height of the head portion and the height of the base portion are reduced without slitting the rail or the bar, feeding the bar through a second reduction pass in which the height of the former head portion and the height of the former base portion are reduced such that the height of the former head portion, the height of the former base portion, and the web portion are substantially equal to each other, slitting the bar along the web portion into two substantially identical pieces, one piece containing the former head portion and one piece containing the former base portion, as the bar leaves the second reduction pass, rolling the two pieces of the bar through a series of reduction passes to produce a desired final cross section of the pieces, whereby both bars are passed through identical shaped rollers to produce substantially identical shaped bar pieces.

12. The method according to claim 11, wherein in the first reduction pass, as the rail is deformed into the bar, the height of the web portion remains substantially unchanged.

13. The method according to claim 11, wherein in the second reduction pass the bar is further deformed so as to make the former head portion smaller and the former base portion smaller than their heights following the first reduction pass.

14. The method according to claim 11, wherein in the second reduction pass, the heights of the former head portion, the former base portion and the web portion are made substantially identical.

15. The method according to claim 11, wherein during said step of rolling the two pieces of the bar through said series of reduction passes, the two pieces of the bar both pass through the same reduction passes, with one of the two pieces of the bar passing through each pass before the other of the two pieces of the bar.

* * * * *